US006363979B1

(12) United States Patent
Chafin et al.

(10) Patent No.: US 6,363,979 B1
(45) Date of Patent: Apr. 2, 2002

(54) APPARATUS AND METHOD FOR TRANSFERRING FLUIDS FROM FLEXIBLE CONTAINERS

(75) Inventors: William C. Chafin, Smyrna; Mark N. Hobart, Kennesaw; Jay W. Wyant, Jr., Acworth, all of GA (US)

(73) Assignee: Cooltools, Acworth, GA (US)

( * ) Notice: Subject to any disclaimer, the term of this patent is extended or adjusted under 35 U.S.C. 154(b) by 0 days.

(21) Appl. No.: 09/653,826

(22) Filed: Sep. 1, 2000

Related U.S. Application Data

(60) Provisional application No. 60/161,262, filed on Oct. 25, 1999, and provisional application No. 60/152,181, filed on Sep. 2, 1999.

(51) Int. Cl.[7] ..... B65B 3/16

(52) U.S. Cl. ..... 141/114; 141/2; 141/392; 222/206; 222/213; 215/229

(58) Field of Search ..... 215/229; 222/92, 222/107, 206, 212, 213; 141/2, 114, 279, 319, 382, 387, 388, 389, 392; 220/709

(56) References Cited

U.S. PATENT DOCUMENTS 4,548,344 A * 10/1985 Hestehave et al. ..... 222/464
5,048,705 A * 9/1991 Lynd et al. ..... 215/1 A
5,154,213 A * 10/1992 Malamas et al. ..... 141/382
5,388,712 A * 2/1995 Brody ..... 215/229
5,897,013 A * 4/1999 Manganiello ..... 220/252

* cited by examiner

*Primary Examiner*—Timothy L. Maust
(74) *Attorney, Agent, or Firm*—Thomas, Kayden, Horstmeyer & Risley

(57) ABSTRACT

An apparatus and method for transferring fluids from a fluid container to a fluid reservoir are disclosed. More particularly, the fluid transfer apparatus is directed to the transfer of fluids from commercially supplied plastic containers to various fluid and lubricant reservoirs. The invention enables contaminant and drip free transfer of fluids from locations both above and below the reservoir opening and provides for the precise volumetric measurement of the fluid transferred. The fluid transfer apparatus may comprise a cap with a bore through its upper surface configured to closely receive a tube. The tube may be extended with a suitable length of flexible tubing having an inner diameter configured to closely receive the tube. The present invention can also be viewed as providing a method for transferring fluid. In its broadest terms, the method can be described by the following steps: placing the fluid transfer apparatus on the spout of a fluid container, supplying a sufficient amount of torque to the cap, placing the distal end of the tube near a designated port, adjusting the proximal end of the tube such that it is submersed within the fluid, and applying pressure to the exterior surfaces of the fluid container. Once an operator stops applying sufficient pressure to the fluid container the fluid in the apparatus returns to the fluid container. In an alternative method, an operator may extend the tube and perform the fluid transfer by pouring the fluid.

25 Claims, 5 Drawing Sheets

APPARATUS AND METHOD FOR TRANSFERRING FLUIDS FROM FLEXIBLE CONTAINERS

CROSS-REFERENCE TO RELATED APPLICATION

The present application claims the benefit of co-pending U.S. Provisional Patent Application, issued serial No. 60/152,181, filed Sep. 2, 1999, and entitled, "Apparatus for Transferring Fluids From Flexible Containers," which is hereby incorporated by reference in its entirety. The present application also claims the benefit of co-pending U.S. Provisional Patent Application, issued serial No. 60/161,262, filed Oct. 25, 1999, and entitled, "Apparatus for Transferring Fluids From Flexible Containers," which is also hereby incorporated by reference in its entirety.

BACKGROUND OF INVENTION

1. Field of the Invention

The present invention generally relates to the transfer of fluids, and more particularly to an apparatus and method for transferring fluids and lubricants from commonly supplied plastic containers to various fluid and lubricant ports and reservoirs.

2. Discussion of the Related Art

A host of lubricants and fluids are commonly marketed in plastic containers. A common method of transferring these fluids and lubricants is to insert any of a number of different known funnels into the designated port connected to the fluid reservoir of interest and simply opening the container and pouring the fluid into the funnel. This gravity driven method requires the fluid to be supplied from a position above the reservoir opening or ultimately requires an operator to move a funnel connected to a tube higher than the reservoir opening. The gravity driven prior art method requires the operator to dispense a portion of the fluid, reposition the fluid container in order to determine the volume of fluid dispensed, and reposition the fluid container over the funnel or the fluid reservoir repetitively, until the desired fluid volume has been transferred. The method is not drip free and exposes the fluid to possible contamination from debris that might fall into the funnel or into the spout of the fluid container. Not only is the fluid exposed to possible contaminants, but funnels that are not cleaned after an initial fluid transfer are known to retain contaminants if the residual fluid is allowed to remain on the various surfaces of the funnel. If the funnel is not thoroughly cleaned prior to its next use, the operator runs the risk of contaminating the fluid. The presence of increased contaminants in engine and other mechanical lubricants has long been known to decrease part life by increasing wear on parts with tight tolerances. In addition, many reservoir openings are located in tight positions within engine compartments where it is impossible to insert a funnel of adequate proportion to enable a transfer of an appropriate fluid.

Accordingly, there is a need and desire for an apparatus that will allow for the drip free transfer of fluids from a host of positions, including those positions below the reservoir opening that provides for the precise volumetric measurement of the fluid transferred to both readily accessible and heretofore relatively inaccessible reservoir ports and eliminates the need to clean a funnel to reduce the introduction of contaminants upon subsequent uses.

SUMMARY OF INVENTION

Certain objects, advantages and novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out.

To achieve the advantages and novel features, the present invention is generally directed to an apparatus configured to universally adapt to plastic containers commonly used to market engine and or motor lubricants and other fluids. The apparatus consists of a tube and a threaded cap configured to seal a flexible (i.e., squeezable) commercial fluid container.

The cap has a bore through its upper wall shaped for closely receiving the tube. The cap is further configured with a thread arrangement appropriate to match and seal the spout of a commercial fluid container.

The cap of the present invention may be manufactured from HDPE or other plastics commonly used in containers used in the commercial distribution of fluids and lubricants. The cap may be configured with a rigid annular extension aligned with the bore whereby the height of the space through both the upper wall and the region enclosed by the rigid annular extension is greater than the thickness of the upper wall of the cap. The rigid annular extension and the interior surface of the upper wall of the cap formed by the bore substantially align the longitudinal axis of the tube such that it is in a plane perpendicular to the upper wall of the cap.

The cap may also be configured with an annular ridge disposed on the lower surface of the upper wall of the cap. The annular ridge, together with the interior surfaces of the cap form a channel for the spout of the commercial container. The channel works together with the threads of the cap to seal the cap to the spout of the commercial container.

It will be appreciated by those skilled in the art that the cap may be further configured to accept one or more washers or other sealing devices (e.g., o-rings) in the upper wall of the cap within the cap channel, on the surface of the annular ridge extending from the interior of the upper wall of the cap, and/or on the interior surface of the rigid annular extension. The one or more sealing devices may further seal the cap to the tube and the cap to the commercial container. In a preferred embodiment, the cap is not supplied with sealing devices as typical washer, gasket and o-ring materials often breakdown when introduced to the various chemical additives that may be present in commercially available fluids.

In a preferred embodiment, the cap contains two or more diametrically opposed tabs extending from the outer surface of the cap, as well as, a plurality of easy grip ridges disposed on the outer surface of the cap. The tabs and ridges increase the surface area of the cap thereby enabling an operator to apply the force necessary to seal the cap to the commercial fluid container as previously described.

Having described the cap of the fluid transfer apparatus of the present invention, reference is now made to the tube of the fluid transfer apparatus. The tube has a flared end for placement within the commercial fluid container and a distal end for placement in or near a fluid reservoir to enable the operator to manipulate the tube in relationship to the cap such that the flared end of the tube is placed at any desired depth within the fluid of the container. The flared end of the tube enables nearly all of the fluid from the commercial container to be transferred from the container through the apparatus by simply applying pressure to the external walls of the fluid container.

As pressure is applied to the container, the fluid therein is expelled through the tube. Subsequently, when pressure is released from the container, a vacuum is maintained by a seal formed between the tube and the cap, as well as, a seal between the cap and the commercial container whereby residual fluid in the tube is drawn back into the container. The flared end also serves to prevent the removal of the tube from the commercial container. The distal end of the tube can be shaped to interface with specific reservoir openings from specific orientations or may be extended by adding a flexible tube or tubes of desired length to enable the transfer of fluids to reservoir openings.

The apparatus of the present invention can be used in a drip and contaminant free method of dispensing engine oil, brake fluid, transmission fluid, as well as, a multitude of other fluids. Most importantly, the apparatus can be used to dispense fluids in automobiles, motorcycles, boats, trucks, lawnmowers, recreational vehicles, power tools, and any of a multitude of mechanical applications where access to fluid ports ranges from easy to difficult. The apparatus of the present invention allows an operator to properly and easily apply fluids to locations within confined areas.

In accordance with the method of the present invention, the operator removes the cap from the commercially supplied fluid container and replaces the original cap with the cap and tube of the fluid transfer apparatus. After a sufficient amount of torque is applied to the cap of the fluid transfer apparatus, a leak proof seal is formed between the commercial container and the cap and tube of the present invention. The operator configures the apparatus for dispensing fluid by pushing the tube into the container such that the flared end of the tubing is immersed within the fluid in the container and placing the distal end of the tube in the reservoir opening of the reservoir to be filled.

After the operator has added the cap and the tube of the present invention to the commercial container as described above, fluid can be transferred in either of two ways. Using a first preferred method, the operator transfers fluid from the container to the reservoir by applying pressure to the external walls of the container. The operator can control the rate of fluid transfer by simply increasing or decreasing the amount of pressure applied to the external walls of the container. This can be accomplished by simply squeezing the container when the operator desires to transfer fluid. Using the alternative method, the operator can transfer fluid using the fluid transfer apparatus of the present invention by simply tilting the container and pouring the fluid through the tube into the desired reservoir. It is significant to note that the tube of the fluid transfer apparatus is operator adjustable with regard to its relative position with the cap. The combination of an operator adjustable fluid "delivery" tube with a leak proof seal permits an operator to place the apparatus in various orientations to deliver fluid at fluid reservoir ports in difficult to access locations.

If the container is held in an upright position at eye level, the operator can observe the volume of fluid transferred by noting the fluid level on the volumetric scale typically provided on the side of the container as fluid is transferred from the commercial container to the desired fluid reservoir. The fluid transfer apparatus of the present invention also provides the operator with greater control of the volume of fluid transferred to the reservoir as the operator directly supplies the pressure on the commercial container.

After the fluid transfer is complete, the operator can remove the fluid from the external surface of the tube by simply pulling the tube until the flared end contacts the inner surface of the upper wall of the cap. Fluid is wiped off the external surface of the tube because of the close configuration of the cap against the external surface of the tube. Since the apparatus is self contained, the operator can ensure contaminant free future transfers of fluid from the same container by simply plugging or capping the distal end of the tube and or leaving the cap of the present invention tightly sealed against the spout of the commercial container until further fluids are desired to be transferred.

Therefore, what is provided is an improved apparatus and method for transferring fluids that enables drip free fluid transfer from a location above or below the opening of the reservoir, that provides for the precise volumetric measurement of the fluid transferred while removing the necessary step of cleaning the surfaces of a standard funnel in order to provide for contaminant free present and future fluid transfers.

BRIEF DESCRIPTION OF THE DRAWINGS

The accompanying drawings incorporated in and forming a part of the specification, illustrate several aspects of the present invention, and together with the detailed description serve to explain the principles of the invention. Furthermore, the drawings are not necessarily to scale, emphasis instead being placed upon clearly illustrating the principles of the invention. Finally, like reference numerals in the figures designate corresponding parts throughout the several drawings. In the drawings.

DETAILED DESCRIPTION OF THE PREFERRED EMBODIMENTS

Figure 1:
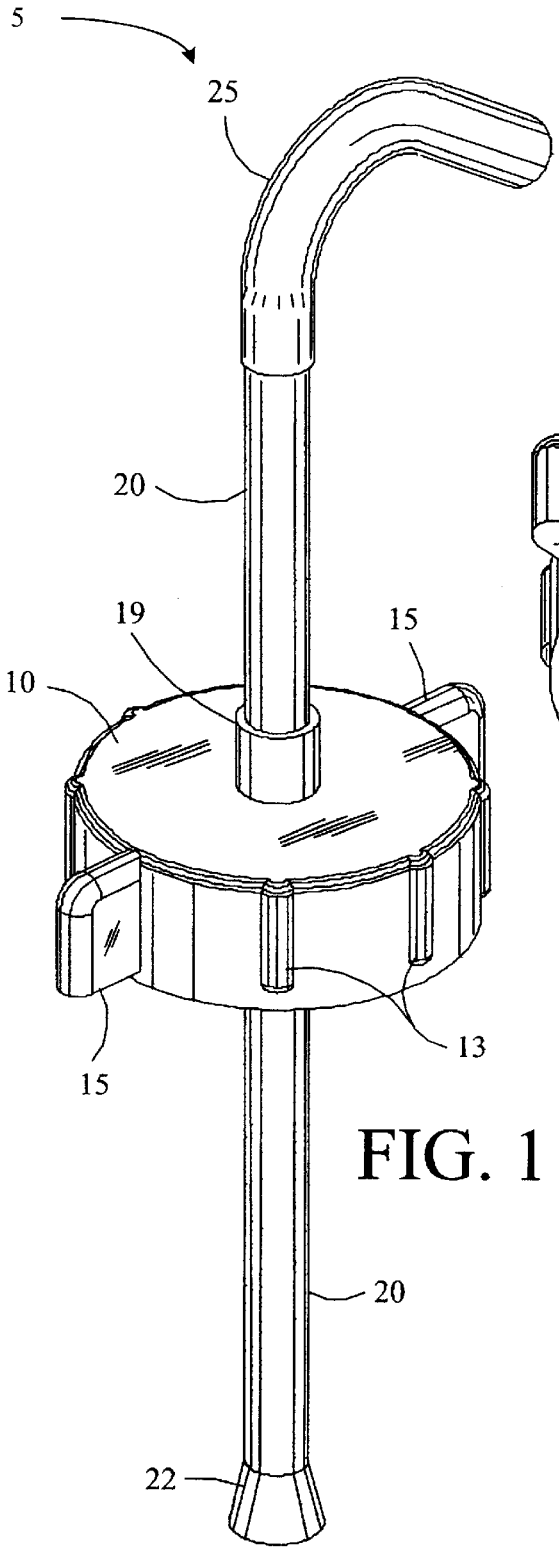
FIG. 1 is a first perspective view of a fluid transfer apparatus in accordance with the present invention.

A fluid transfer apparatus in accordance with the present invention will now be specifically described in detail in the context of transferring commercially available automotive fluids from flexible containers. However, it should be noted that the fluid transfer apparatus and the fluid transfer method of the present invention may be practiced using other fluids and fluid containers that are suited for the method, as will be apparent to those skilled in the art.

Having summarized the invention above, reference will now be made in detail to the description of the invention as illustrated in the drawings. While the invention will be described in connection with these drawings, there is no intent to limit the invention to the embodiment or embodiments disclosed therein. On the contrary, the intent is to cover all alternatives, modifications and equivalents included within the spirit and scope of the invention.

Turning now to the drawings, reference is now made to FIG. 1, which illustrates a first perspective view of a fluid transfer apparatus in accordance with the present invention. In this regard, a fluid transfer apparatus 5 may comprise a cap 10 and a rigid tube 20. As illustrated in FIG. 1, the rigid tube 20 may have a flared end 22 and a distal end that may be extended with a flexible tube 25 having a suitable inner diameter to closely contact the outer surface of the rigid tube 20. In preferred embodiments, the flexible tube 25 may be translucent and or transparent in order to permit an operator of the fluid transfer apparatus 5 to easily observe the transfer of fluid through the apparatus. As further illustrated in FIG. 1, the cap 10 may have an annular extension 19 configured to closely contact the outer surface of the rigid tube 20. In addition, the cap 10 may contain two or more diametrically opposed tabs 15 extending from the outer surface of the cap, as well as, a multiplicity of easy grip ridges 13 disposed on the outer surface of the cap. The tabs 15 and ridges 13 increase the surface area of the cap 10 thereby enabling an operator to apply the force necessary to seal the cap 10 to a commercial fluid container.

Figure 2:
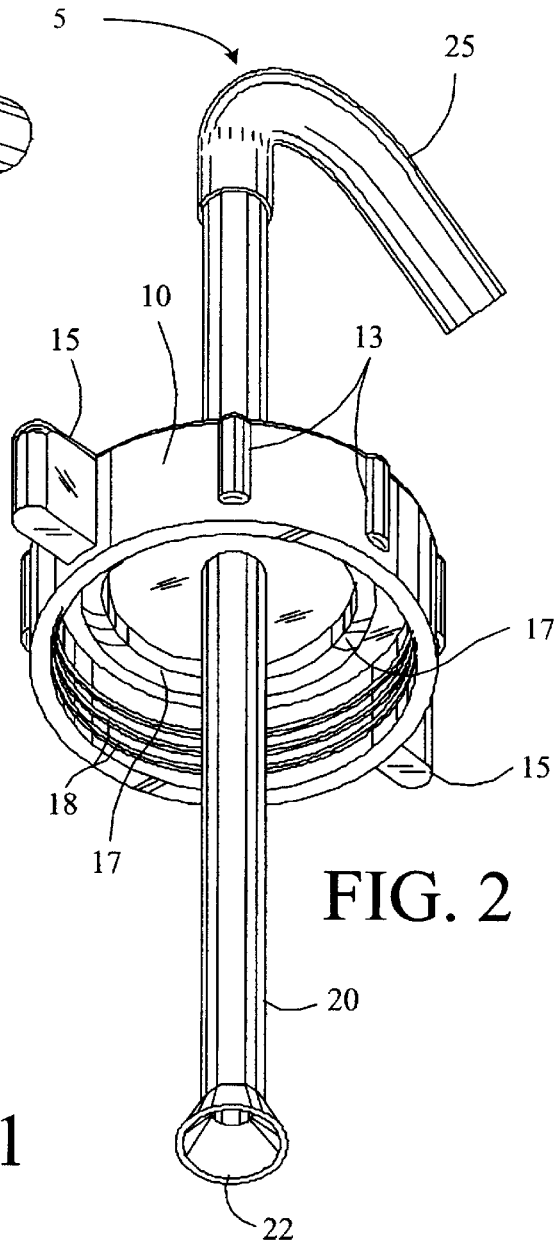
FIG. 2 is a second perspective view of the fluid transfer apparatus introduced in FIG. 1.

Having briefly described a fluid transfer apparatus 5 in accordance with the present invention with regard to the perspective view of FIG. 1, reference is now directed to a second perspective view as illustrated in FIG. 2. In this regard, FIG. 2 reveals some additional features of the cap 10 of the fluid transfer apparatus 5.

As illustrated in FIG. 2, a fluid transfer apparatus 5 in accordance with the present invention may comprise the cap 10 and a rigid tube 20. As further illustrated in FIG. 2, the rigid tube 20 may have a flared end 22 and a distal end that may be extended with a flexible tube 25 as previously described in association with FIG. 1. In addition to the various external features introduced with the description of FIG. 1, the cap 10 as illustrated in FIG. 2, may further comprise an inner surface 18 suitably threaded to affix the cap 10 on a commercial fluid container. As also illustrated in FIG. 2, the lower surface of the top of the cap 10 may comprise an annular ridge 17. The annular ridge 17 together with the interior surfaces of the cap may form a channel 16 configured to closely receive the upper portion for the spout of a commercial container. The channel 16 works together with the threads 18 of the cap 10 to seal the cap 10 to the spout of a commercial container.

Once a target reservoir has been sufficiently supplied with fluid from the container, an operator may introduce a suitably configured plug or a sealing cap (not shown) into the distal end of the flexible tube 25 or alternatively the distal end of the rigid tube 20 when the operator elects not to add the flexible tube 25. In this way, any remaining fluid within the combination of the fluid transfer apparatus 5 and the fluid container 40 may be kept safe from contaminants that might be introduced to the fluid.

Figure 3:
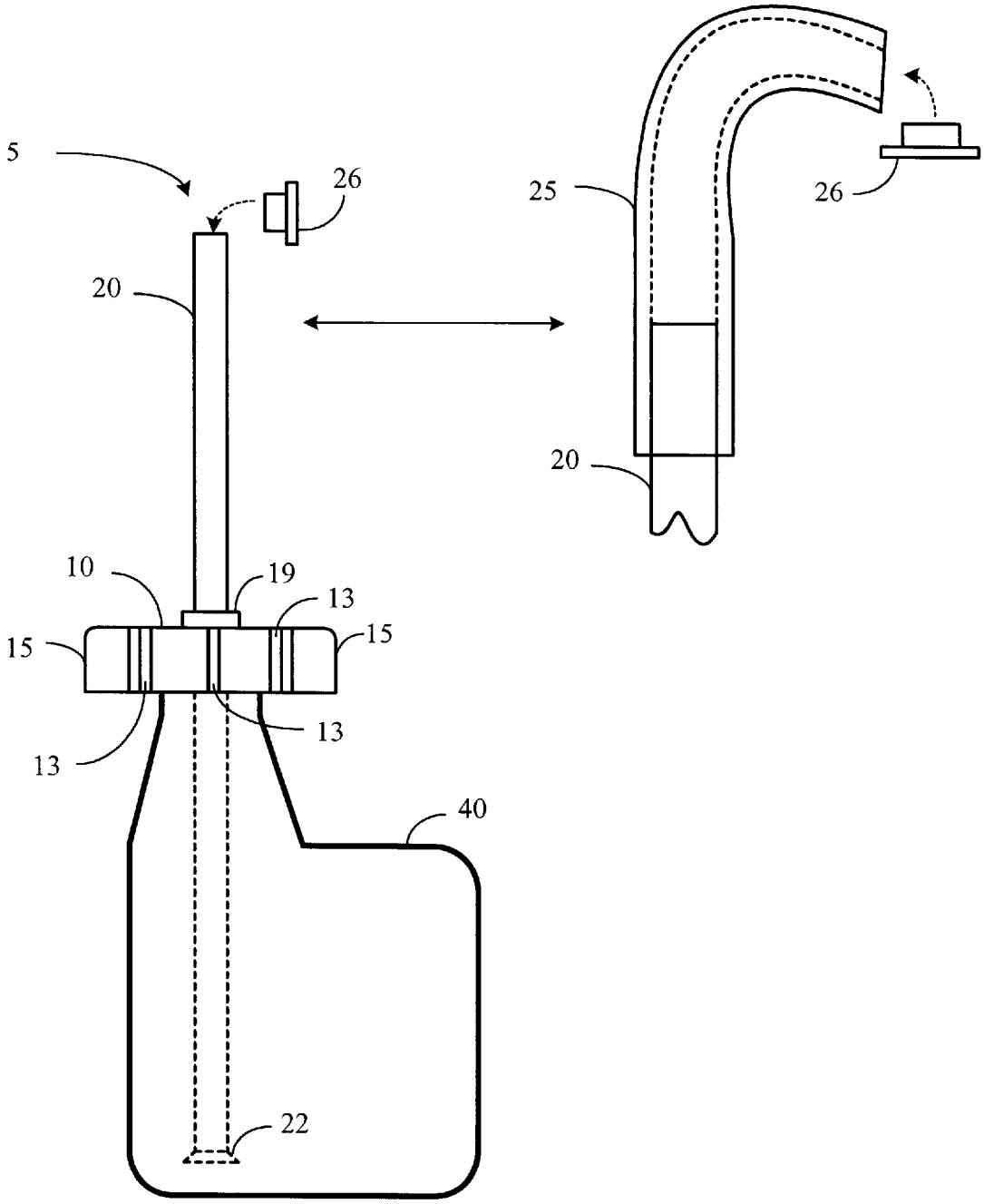
FIG. 3 is a diagram that illustrates the fluid transfer apparatus of FIGS. 1 and 2 associated with a commercially supplied fluid container.

Having briefly described a fluid transfer apparatus 5 in accordance with the present invention with regard to the perspective views illustrated in FIGS. 1 and 2, reference is now directed FIG. 3, which illustrates the fluid transfer apparatus 5 of the present invention associated with a commercially supplied fluid container.

As illustrated in FIG. 3, a commercial fluid container 40 may be connected to the apparatus of the present invention. The cap 10 of the fluid transfer apparatus 5 of the present may fit over the spout of the commercial fluid container 40. Rigid tube 20 may be received through the annular extension 19 and the upper wall of the cap 10 such that the flared end 22 of the rigid tube 20 may be placed into the fluid within commercial fluid container 40. As further illustrated in FIG. 3, in addition to the annular extension 19, the cap 10 may comprise a plurality of tabs 15 and a plurality of ridges 13. As previously described with regard to the perspective view of FIG. 1, the tabs 15 and ridges 13 permit operators to apply more torque to the external surface of cap 10 when placing or removing the fluid transfer apparatus 5 from a commercial container 40. FIG. 3 also illustrates an alternative configuration for the distal end of the rigid tube 20. In an alternative configuration, flexible tube 25 may be added over the end of rigid tube 20 to permit fluid transfer in a host of reservoir openings located in areas with limited access.

It will be appreciated by those of ordinary skill in the art that flexible tube 25 can be configured in different lengths and be constructed of chemically resistant materials that allow for a range of flexibility. In this manner, the flexible tube 25 can be manipulated into semi-permanent shapes while permitting complete flexibility in allowing access to both readily accessible and relatively inaccessible fluid reservoir ports.

As also illustrated in the alternative configuration for the distal end of the rigid tube 20 of FIG. 3, the flexible tube 25 may be sealed with an appropriately sized sealing plug 26 to prevent the introduction of airborne contaminants during periods of non-use when the fluid transfer apparatus 5 remains in leak-proof association with a fluid container 40. Alternatively, the flexible tube 25 may be temporarily sealed by an appropriate configured sealing cap (not shown). As with the cap 10 and the flexible tube 25, either alternative sealing device may be constructed of a material that resists chemical breakdown when placed in direct contact with the fluids intended to be transferred. It is significant to note that the fluid transfer apparatus 5 provides a relatively spill-proof solution to fluid transfer as it permits an operator to transfer the contents of a fluid container 40 directly from the fluid container 40 to a designated fluid reservoir port without introducing the fluid to unintended surfaces or the ground.

It will be appreciated by those skilled in the art that the cap 10 may be configured to accept one or more washers or other sealing devices (e.g., o-rings) (not shown). In this regard, one or more washers may be disposed in the upper wall of the cap 10 within the cap channel 16, on the surface of the annular ridge 17 extending from the interior of the upper wall of the cap, and/or on the interior surface of the rigid annular extension 19. The one or more sealing devices may further seal the cap 10 to the tube 20 and the cap 10 to the commercial fluid container 40.

Figure 4:
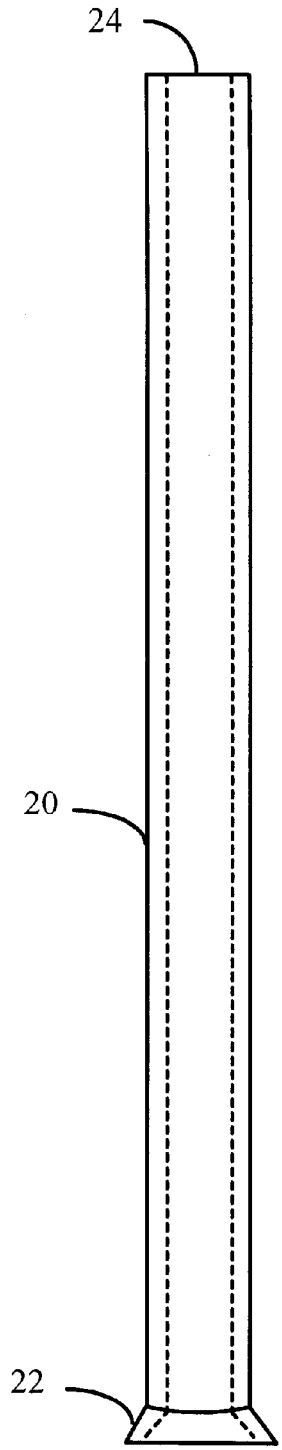
FIG. 4 is a diagram further illustrating the tube of the fluid transfer apparatus of FIGS. 1 through 3.

Reference is now made to FIG. 4, which illustrates the rigid tube 20 of the fluid transfer apparatus 5 of the present invention. Note that rigid tube 20 has a flared end 22 for placement within a commercial container and a distal end 24. The distal or non-flared end 24 may be configured with a "hooked" configuration (not shown) to enable placement within a reservoir opening. However, in preferred embodiments a flexible tube 25 (FIGS. 1 through 3) may be added to adaptively configure the distal end 24 of the rigid tube 20 with a designated fluid port. As illustrated in FIG. 4, the non-flared distal end 24 of rigid tube 20 may be cut perpendicular to the longitudinal axis of the tube to permit the addition of a flexible tube 25 as was shown in FIGS. 1 through 3. It will be appreciated by those skilled in the art that the length of the flexible tube 25 may be selected as appropriate to permit an operator to use the fluid transfer apparatus 5 to complete a desired fluid transfer. Redirecting attention back to the rigid tube 20, it is significant to note that the rigid tube 20 can be constructed from any material that resists chemical breakdown when placed in direct contact with the fluids intended to be transferred through the tube.

The flared end 22 of rigid tube 20 serves two purposes. First, it serves as a physical stop to prevent the operator from being able to completely remove the rigid tube 20 from the cap 10 (FIG. 1). Second, the flared end allows the fluid transfer apparatus 5 of the present invention to transfer nearly all the fluid from commercial container 40 (FIG. 1).

Figure 5:
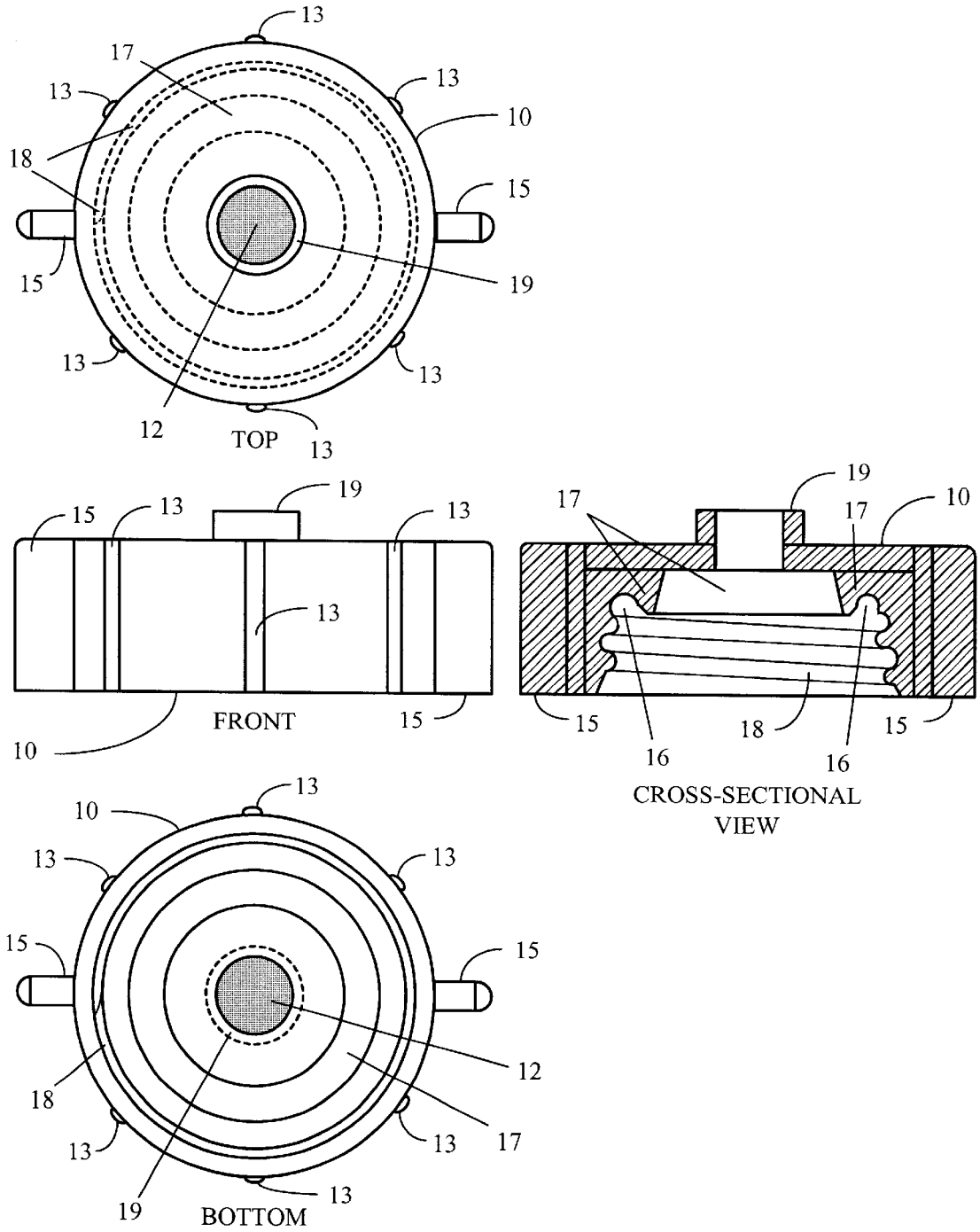
FIG. 5 is a diagram that further illustrates the cap of the fluid transfer apparatus of FIGS. 1 through 4.

Having described the rigid tube 20 of the fluid transfer apparatus 5 of the present invention with regard to the illustration of FIG. 4, reference is now directed to FIG. 5. In this regard, FIG. 5 presents a top, front, bottom, and cross-sectional views of the cap 10. As illustrated in the top, bottom, and cross-sectional views of FIG. 5, the cap 10 may have a bore 12 through its upper wall shaped for closely receiving the tube 20. As further illustrated in the four views of FIG. 5, the bore 12 may be extended by the annular extension 19. The bore 12 and the annular extension 19 serve to both closely receive and align the rigid tube 20 (FIGS. 1 through 3) thereby keeping the longitudinal axis of the rigid tube 20 substantially perpendicular to the upper wall of the cap 10.

As illustrated in the top, bottom, and cross-sectional views, the inner surface 18 of the cap 10 may be threaded such that the upper surface of a spout of a commercial container 40 (not shown) is closely received within a channel 16 formed between the inner wall of the cap 10 and the annular ridge 17. Those skilled in the art will appreciate that the cap 10 may be configured with a thread arrangement appropriate to match and seal the spout of a designated commercial fluid container 40 (not shown).

As previously described, the external surface of the cap 10 may comprise a plurality of tabs 15 along with a plurality of ridges 13 as illustrated in the various views of FIG. 5 to provide sufficient surface area for an operator to sufficiently tighten the cap 10 onto the spout of a commercial fluid container 40 (FIG. 3). In this way, the channel 16 formed by the inner surface of the cap 10 and the annular ridge 17 further enables the drip free transfer of fluid by preventing fluid from leaking between the cap 10 and the spout of the commercial container 40 (FIG. 1).

The cap 10 of the present invention may be manufactured from HDPE or other plastics commonly used in containers used in the commercial distribution of fluids and lubricants. In this way, cap 10 may be constructed of a material that resists chemical breakdown when placed in direct contact with the fluids intended to be transferred by the fluid transfer apparatus 5 of the present invention.

Figure 6:
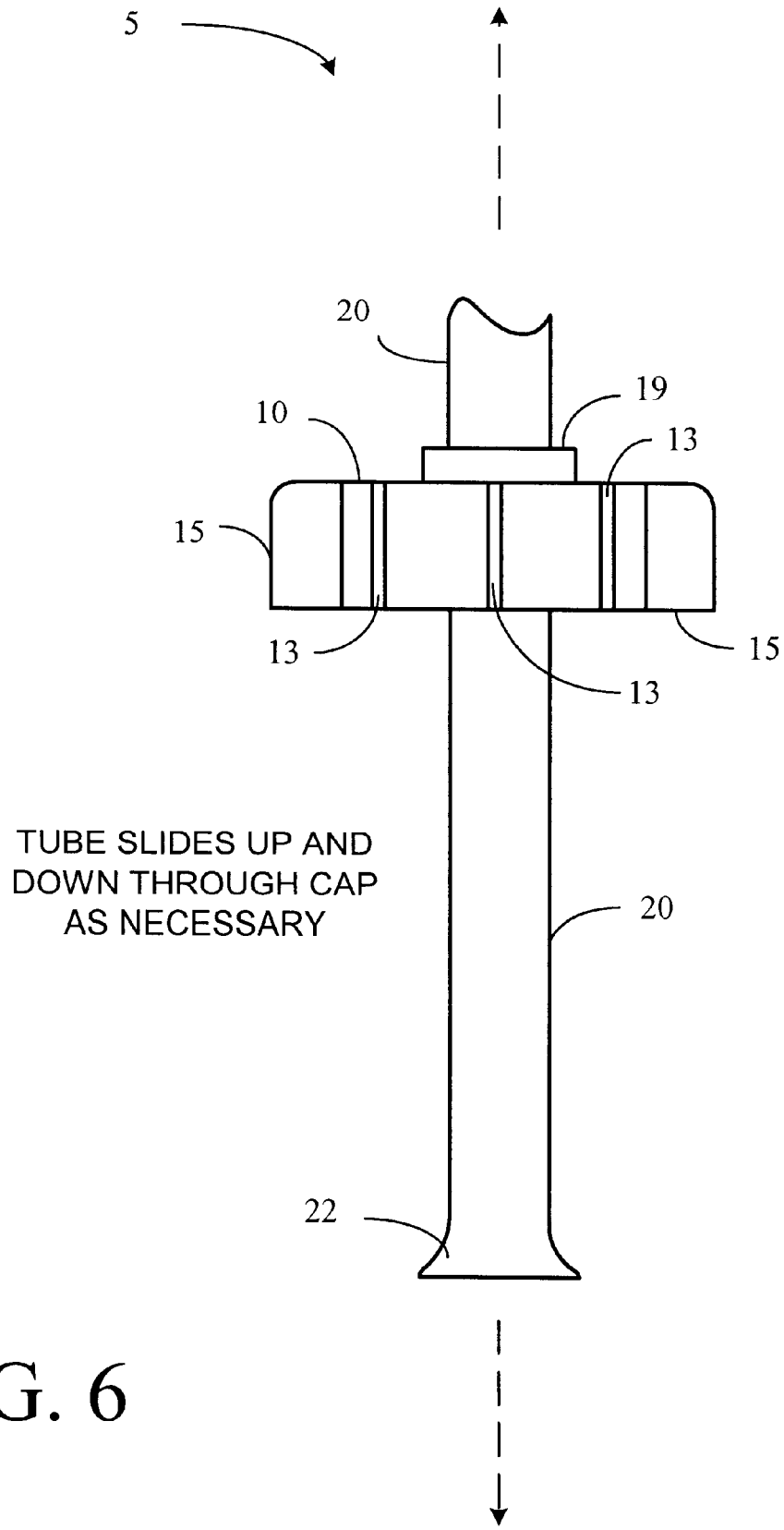
FIG. 6 is a diagram that illustrates the relationship between the cap and the tube of the fluid transfer apparatus of FIGS. 1 through 4.

Having further described the structure and operation of the cap 10 of the fluid transfer apparatus 5 of the present invention with regard to the various views presented in FIG. 5, reference is now directed to FIG. 6. In this regard, FIG. 6 illustrates the operation of the cap 10 and the rigid tube 20 of the fluid transfer apparatus 5 in accordance with the present invention. As shown in FIG. 6, the rigid tube 20 can be moved up and down within the bore 12 in the upper wall of the cap 10. As a portion of the length of the rigid tube 20 is removed from the commercial container 40, fluid on the outer surface of rigid tube 20 within commercial container 40 is wiped off the external surface of tube 20 by the inner surface of the cap 10 which forms bore 12 and the annular extension 19 (FIG. 3).

As previously described, the depth of the flared end 22 of the rigid tube 20 can be adjusted by pushing that portion of the rigid tube 20 external to the commercial container 40 into the container. In this way, an operator can adjust the fluid transfer apparatus 5 such that the flared end 22 of the rigid tube 20 is immersed in the fluid within the container, thereby enabling fluid transfer to a reservoir or port located above the container (FIG. 1). It is significant to note that the rigid tube 20 and the cap 10 as illustrated and described hereinabove, form a leak proof and user adjustable seal with the commercial fluid container 40. An operator may adjust the length of the rigid tube that extends above the upper surface of the cap without having to clean the outer surface of the rigid tube 20 and without having to remove the cap 10 from the spout of the commercial container 40. This is important for at least two reasons. First, the operator can transfer fluids without spilling, dripping, or coming into contact with the fluid. Second, the fluid itself remains contaminant free during the fluid transfer process as it is never exposed to the environment and external surfaces.

The foregoing description has been presented for purposes of illustration and description. It is not intended to be exhaustive or to limit the invention to the precise forms disclosed. Obvious modifications or variations are possible in light of the above teachings. For example, those skilled in the art will appreciate that a washer constructed of a material compatible with the fluid designated to be transferred may be introduced within the channel 16 formed by the inner wall of the cap 10 and the annular ridge 17 located on the underside of the cap. All such variations are within the scope of the fluid transfer apparatus 5 of the present invention. The embodiment or embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly and legally entitled.

What is claimed is:

1. An apparatus for transferring fluid from a motor fluid container comprising:

an inflexible tube having a bore extending therethrough, the tube having a flared end and a distal end; and a cap with a bore through the upper wall configured to closely receive and pass the tube therethrough, wherein a leak proof seal is formed between the cap and the tube permitting contaminant free transfer of the fluid from the motor fluid container and wherein the flared end of the tube is located within the motor fluid container and prohibits the tube from being pulled out of the bore of the cap, and wherein the smooth surface of the tube allows the tube to be adjustable along its longitudinal axis in relation to the cap while maintaining a second leak-proof seal between the cap and the tube.

2. The apparatus as defined in claim 1, wherein the tube is constructed of a chemically resistant material.

3. The apparatus as defined in claim 1, wherein the proximal end of the tube is flared.

4. The apparatus as defined in claim 1, wherein the cap is constructed of a chemically resistant material.

5. The apparatus as defined in claim 1, wherein the cap is further constructed with an annular ridge disposed on the internal surface of the upper wall, said annular ridge of a diameter such that a channel is formed between the inner wall of the cap the upper surface of the interior of the cap and the annular ridge.

6. The apparatus as defined in claim 5, wherein the cap is further constructed with an internal thread.

7. The apparatus as defined in claim 6, wherein the internal thread is arranged to associate with an external thread on a fluid container.

8. The apparatus as defined in claim 1, further comprising:

a flexible tube having a bore extending therethrough configured with an inner diameter to closely receive the distal end of the tube.

9. The apparatus as defined in claim 1, wherein the flexible tube is constructed of a chemically resistant material.

10. An apparatus for transferring fluid from a motor fluid container comprising:

an inflexible tube having a bore extending therethrough, a flared end, a distal end, and a smooth outer surface; and a cap having a bore through the upper wall configured to closely receive and pass the tube therethrough, a plurality of ridges disposed on the outer surface of the cap, and a plurality of tabs extending from the cap and beyond the ridges, wherein the cap is adapted to engage the motor fluid container forming a first leak proof seal between the cap and the motor fluid container, and wherein the smooth surface of the tube allows the tube to be adjustable along its longitudinal axis in relation to the cap while maintaining a second leak-proof seal between the cap and the tube.

11. A method for transferring fluid comprising:

removing a first cap from a motor fluid container;

replacing the first cap with a fluid transfer apparatus having a cap and a tube, wherein the cap has a bore through the upper wall configured to closely receive and pass the tube therethrough, a plurality of ridges disposed on the outer surface of the cap, and a plurality of tabs extending from the cap and beyond the ridges, and wherein the tube has a flared end and a distal end; and supplying a sufficient amount of torque to the plurality of tabs on the cap of the fluid transfer apparatus to form a leak proof seal between the cap to the spout of the motor fluid container.

12. The method as defined in claim 11, wherein the step of applying pressure is replaced with pouring the fluid from the fluid container through the tube.

13. The method as defined in claim 11, wherein substantially all the fluid from the fluid container is expelled from the container.

14. The method as defined in claim 11, further comprising:

regulating the rate of fluid transfer by adjusting the relative pressure applied to the exterior surface of the fluid container.

15. The method as defined in claim 11, further comprising:

monitoring the volume of fluid transferred by observing the fluid level on a volumetric scale integrated with the fluid container.

16. The method as defined in claim 15, further comprising:

removing pressure from the external surface of the fluid container once a user designated volume of fluid has been transferred such that residual fluid within the apparatus is returned to the fluid container.

17. The method of claim 11, further comprising the steps of:

placing the distal end of the tube into a designated port;

adjusting the flared end of the tube such that the flared end is submersed in a motor fluid within the motor fluid container; and applying pressure to the exterior surface of the motor fluid container thereby controllably expelling a determinable portion of the motor fluid from the motor fluid container.

18. The apparatus as defined in claim 10, wherein the tube is constructed of a chemically resistant material.

19. The apparatus as defined in claim 10, wherein the proximal end of the tube is flared.

20. The apparatus as defined in claim 10, wherein the cap is constructed of a chemically resistant material.

21. The apparatus as defined in claim 10, wherein the cap is further constructed with an annular ridge disposed on the internal surface of the upper wall, said annular ridge of a diameter such that a channel is formed between the inner wall of the cap the upper surface of the interior of the cap and the annular ridge.

22. The apparatus as defined in claim 21, wherein the cap is further constructed with an internal thread.

23. The apparatus as defined in claim 22, wherein the internal thread is arranged to associate with an external thread on a fluid container.

24. The apparatus as defined in claim 10, further comprising:

a flexible tube having a bore extending therethrough configured with an inner diameter to closely receive the distal end of the tube.

25. The apparatus as defined in claim 10, wherein the flexible tube is constructed of a chemically resistant material.

* * * * *